US005591560A

United States Patent [19]

Fehervari et al.

[11] Patent Number: 5,591,560

[45] Date of Patent: Jan. 7, 1997

[54] IMAGE-RECEIVING ELEMENT FOR DIFFUSION TRANSFER PHOTOGRAPHIC AND PHOTOTHERMOGRAPHIC FILM PRODUCTS

[76] Inventors: Agota F. Fehervari, 580 Concord Ave., Lexington, Mass. 02173; James A. Foley, 211 Weston Rd., Wellesley, Mass. 02181; Gia Y. Kim, 4732 Cabot La., Laverne, Calif. 91750; Diana R. Koretsky, 592 Highland Ave., Malden, Mass. 02148; Lloyd D. Taylor, One Maureen Rd., Lexington, Mass. 02173; Kenneth C. Waterman, 25 Range Rd., Concord, Mass. 01742

[21] Appl. No.: 568,937

[22] Filed: Dec. 7, 1995

[51] Int. Cl.[6] ..... G03C 8/24; G03C 8/50; G03C 11/12

[52] U.S. Cl. ..... 430/203; 430/215; 430/227; 430/263

[58] Field of Search ..... 430/215, 227, 430/263, 203

[56] References Cited

U.S. PATENT DOCUMENTS

| | | | |
|---|---|---|---|
| 3,674,482 | 7/1972 | Haberlin | 96/29 |
| 3,844,789 | 10/1974 | Bates et al. | 96/68 |
| 4,629,677 | 12/1986 | Katoh | 430/215 |
| 4,871,648 | 3/1989 | Bowman et al. | 430/215 |
| 4,954,419 | 9/1990 | Shinagawa et al. | 430/215 |
| 5,346,800 | 9/1994 | Foley et al. | 430/213 |

*Primary Examiner*—Richard L. Schilling
*Attorney, Agent, or Firm*—Gaetano D. Maccarone

[57] ABSTRACT

An image-receiving element for use in photographic and photothermographic diffusion transfer film units of the type wherein the image-receiving element is designed to be removed or "peeled-apart" from a photosensitive element following exposure and processing. The present image-receiving element comprises in sequence, a support, an image-receiving layer, and a strip-coat layer. The strip-coat layer serves to facilitate separation of the image-receiving layer from a photosensitive element after processing. The strip-coat layer comprises a copolymer including: 1) at least about 50% by weight of monomer units, the same or different, derived from an ethylenically unsaturated carboxylic acid or salt thereof, 2) at least about 15% by weight of monomer units of vinyl pyrrolidone, and 3) at least about 5% by weight of monomer units, the same or different, represented by the formula:

wherein $R_1$ of each monomer unit is independently selected from: hydrogen, a substituted or unsubstituted alkyl having 1 to 4 carbon atoms, cyano, and halogen; X of each monomer unit is independently selected from —NH— or —O—; and $R_2$ of each monomer unit is independently selected from a hydroxy substituted alkyl group.

18 Claims, 1 Drawing Sheet

IMAGE-RECEIVING ELEMENT FOR DIFFUSION TRANSFER PHOTOGRAPHIC AND PHOTOTHERMOGRAPHIC FILM PRODUCTS

BACKGROUND OF THE INVENTION

This invention relates to an image-receiving element for use in photographic and photothermographic film units of the diffusion transfer type. More particularly, the invention relates to an image-receiving element especially adapted for use in diffusion transfer film units wherein an image-receiving element is designed to be separated from a photosensitive element after exposure and processing.

Photographic film units of this type are well known and are often referred to as "peel apart" photographic film units. Various embodiments of peel-apart film units are known and include those wherein images are formed in black and white (reduced silver), and color (image dyes), as described in: E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330; and V. K. Walworth and S. H. Mervis, in J. Sturge, V. Walworth, and A. Shepp, eds., *Imaging Processes and Materials: Neblette's Eighth Edition*, Van Nostrand Reinhold, New York, 1989, pp. 181–225. Additional examples of peel apart film units are described in U.S. Pat. Nos. 2,983,606; 3,345,163; 3,362,819; 3,594,164; and 3,594,165.

In general, diffusion transfer photographic products and processes involve film units having a photosensitive element including a support carrying at least one silver halide emulsion, and an image-receiving element including a support and an image-receiving layer. After photoexposure, the photosensitive element is developed, typically by uniformly distributing an aqueous alkaline processing composition over the photoexposed element, to establish an imagewise distribution of a diffusible image-providing material. The image-providing material, (e.g. image dyes or complexed silver), is selectively transferred, at least in part, by diffusion to the image-receiving layer positioned in a superposed relationship with the developed photosensitive element. The image-receiving layer is capable of mordanting or otherwise fixing the image-providing material and retains the transferred image for viewing. The image is viewed in the image-receiving layer upon separation of the image-receiving element from the photosensitive element after a suitable imbibition period. Black and white transfer images are generally formed by exposing and developing a silver halide emulsion, and subsequently dissolving and transferring silver from unexposed, or less exposed regions, to an image-receiving layer containing silver precipitating agents or nuclei. The transferred silver is reduced to metallic silver in the image-receiving layer, thus forming an image. Color images are generally formed by the imagewise transfer of image dyes from a photosensitive element to an image-receiving layer containing a dye mordant material.

Image-receiving elements particularly adapted for use in peel-apart diffusion transfer film units include an image-receiving layer for retaining the transferred image. This image-receiving layer is typically arranged on a substrate layer of suitable material or a combination of layers arranged on the substrate layer. In one well known photographic embodiment, the image-receiving element comprises a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer or timing layer adapted to slow the diffusion of the alkali of an aqueous alkaline processing composition toward the polymeric neutralizing layer; and an image-receiving layer to receive the transferred photographic image. Such a structure is described, for example, in the aforementioned U.S. Pat. No. 3,362,819 and is illustrated in other patents, including U.S. Pat. Nos. 4,322,489 and 4,547,451.

Photothermographic film products for use in diffusion transfer type processes are also well known in the art. Various embodiments of such film products are known and typically comprise: 1) a photosensitive element including at least one photosensitive silver halide emulsion and a corresponding image providing material (e.g. silver for black and white embodiments, image dyes for color embodiments), and 2) an image-receiving element including an image receiving layer. Typically, the photosensitive element is exposed and subsequently brought in superposed contact with the image-receiving element, wherein the assembly is heated for a predetermined time period. In addition to heating, some applications require a small amount of water to be added to the photosensitive element prior to lamination with the image-receiving element. The application of heat, (and water if used), results in the image-wise diffusion of image materials from the photosensitive element, to the image-receiving element Subsequently, the image-receiving element is separated from the photosensitive element. Various embodiments of photothermographic film units and processes are described in: S. H. Mervis and V. K. Walworth, *Kirk-Othmer Encyclopedia of Chemical Technology*, 4th. Edition, Volume 6, John Wiley & Sons, Inc. 1993, pp. 1036–1039. Specific examples of such film units are described in U.S. Pat. Nos.: 4,631,251; 4,650,748; 4,656,124; 4,704,345; 4,975,361; and 5,223,387.

In both photographic and photothermographic film units, a strip-coat (also referred to as a "stripping layer" or "release layer"), is commonly positioned between the photosensitive element and the image-receiving element to facilitate the separation of the elements from one another after processing. In photographic applications, strip-coats may additionally serve to prevent processing solution from remaining on the image-receiving element after processing. A specific example of such a strip-coat is provided in U.S. Pat. No. 5,346,800 to Foley et al. which describes a strip-coat comprising a hydrophilic colloid, e.g. gum arabic, and an aluminum salt. Other materials are also known for use in strip-coat layers. For example: U.S. Pat. No. 3,674,482 to R. J. Haberlin discloses a strip-coat made of a methyl acrylate/acrylic acid copolymer. U.S. Pat. No. 3,844,789 to Bates et al. discloses a strip-coat prepared from PVP (polyvinyl pyrrolidone). U.S. Pat. No. 4,954,419 to Shinagawa et al. discloses a multi-layer strip-coat including a first a peeling layer containing a copolymer of at least (i) an ethylenically unsaturated monomer containing at least one hydrocarbon group containing from 7 to 18 carbon atoms and (ii) an ethylenically unsaturated monomer, the homopolymer of which is soluble in water or an aqueous alkaline solution. With regard to the monomers which are described as being soluble in water or aqueous alkaline solutions, acrylic acid and vinyl pyrrolidone are listed. It is further disclosed that these constituents may be used either alone in combination.

Materials used in strip-coats may be crosslinked. For example, U.S. Pat. No. 4,629,677 to Katoh discloses a strip-coat comprising a crosslinked copolymer containing more than 40 mole % of a monomer unit derived from an ethylenically unsaturated carboxylic acid or a salt thereof. A specific copolymer disclosed includes a copolymer of acrylic acid and hydroxyethyl methacrylate, (see formula 7 in column 7).

U.S. Pat. No. 4,871,648 to Bowman et al. discloses a strip-coat comprising a copolymer including: (i) one or more randomly recurring units of N-alkyl or N,N-dialkylacrylamides; and optionally, (ii) one or more randomly recurring units of nonionic alkyl-, hydroxyalkyl- (e.g. 2-hydroxyethyl acrylate), or oxaalkylacrylate or methacrylate monomers, or a carboxylic acid group containing monomer; (e.g. acrylic acid); and optionally, (iii) one or more randomly recurring units of polymerized cross-linking monomers having two or more polymerizable groups.

Some strip-coats may produce a noticeable haze over the image-receiving element upon processing and separation from the photosensitive element. It is known that reducing the thickness of the strip-coat will provide some reduction in haze. Such a reduction in the thickness of the strip coat may provide other benefits as well, e.g. an increase in dye transfer therethrough. However, a drawback to providing progressively thinner strip-coats is a reduced effectiveness in facilitating separation between the photosensitive element and the image-receiving element. Furthermore, in photographic embodiments, processing composition often remains adhered to thinner strip-coats after processing and separation from the photosensitive element, thus detracting from the quality of the resulting image. Thus, it is desired to provide a relatively thin strip-coat with low haze which can still effectively facilitate separation between the photosensitive element and the image-receiving element. Furthermore, it is desired to provide such a strip-coat having desirable gloss properties.

SUMMARY OF THE INVENTION

The present invention is an image-receiving element for use in photographic and photothermographic film units of the diffusion transfer type comprising, in sequence: a support; an image-receiving layer; and a strip-coat. The subject strip-coat comprises a copolymer including: 1) at least about 50% by weight of monomer units, the same or different, derived from an ethylenically unsaturated carboxylic acid or salt thereof, 2) at least about 15% by weight of monomer units of vinyl pyrrolidone, and 3) and at least about 5% by weight of monomer units, the same or different, represented by Formula I.

Formula I:

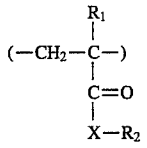

wherein $R_1$ of each monomer unit is independently selected from: hydrogen, a substituted or unsubstituted alkyl having 1 to 4 carbon atoms, cyano, and halogen; X of each monomer unit is independently selected from —NH— or —O—; and $R_2$ of each monomer unit is independently selected from a hydroxy substituted alkyl group.

The disclosed image-receiving element is particularly adapted for use in photothermographic and photographic film elements of the type wherein an image-receiving element is designed to be separated from a photosensitive element after processing. The subject strip-coat is useful in such film units as it facilitates separation of the image-receiving element. Furthermore, the subject strip-coat has desired gloss properties.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

As stated above, the present invention relates to an image-receiving element for use in photographic and photothermographic film units of the diffusion transfer type. More particularly, the present invention is directed toward such film units wherein the image-receiving element is designed to be separated from the photosensitive element after processing. As will be described in detail below, the subject image-receiving element comprises in sequence, a support, an image-receiving layer, and a strip-coat. For purposes of description, a preferred photographic embodiment of the subject image-receiving element will be described in detail below. Those skilled in the art will appreciate that the present invention may be used in other embodiments, including photothermographic film units.

Figure 1:
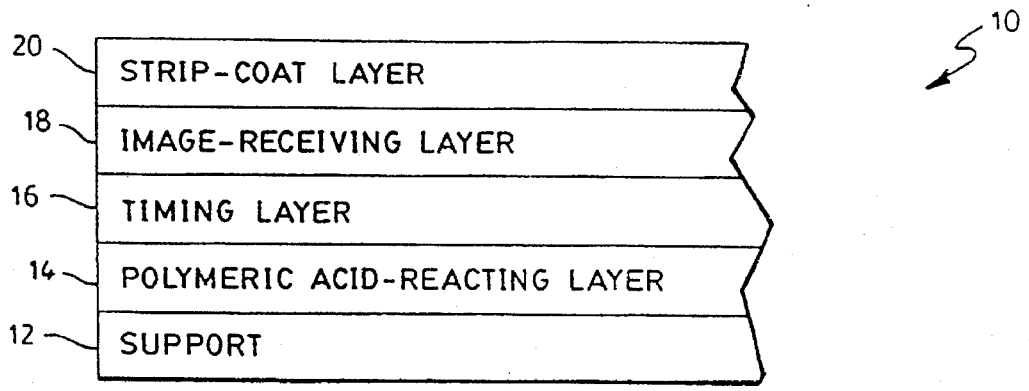
FIG. 1 is a partially schematic, cross-sectional view of one embodiment of an image-receiving element according to the invention.

With reference to FIG. 1, an image-receiving element specifically adapted for use in a photographic peel-apart film unit is generally shown at 10 comprising a support 12 carrying a polymeric acid-reacting layer 14, a timing (or spacer) layer 16, an image-receiving layer 18 and a strip-coat layer 20. Each of the layers carried by support 12 functions in a predetermined manner to provide desired diffusion transfer processing and is described in detail hereinafter. It is to be understood that the image-receiving element of the present invention may include additional layers as is known in the art.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, support material 12 may be transparent, opaque or translucent. Typically, an image-receiving element adapted to be used in peel-apart diffusion transfer film units and designed to be separated after processing will be based upon an opaque support material 12. While support material 12 of image-receiving element 10 will preferably be an opaque material for production of a photographic reflection prim, it will be appreciated that support 12 will be a transparent support material where the processing of a photographic transparency is desired. In one embodiment where support material 12 is a transparent sheet material, an opaque sheet (not shown), preferably pressure-sensitive, can be applied over the transparent support to permit in-light development.

Figure 2:
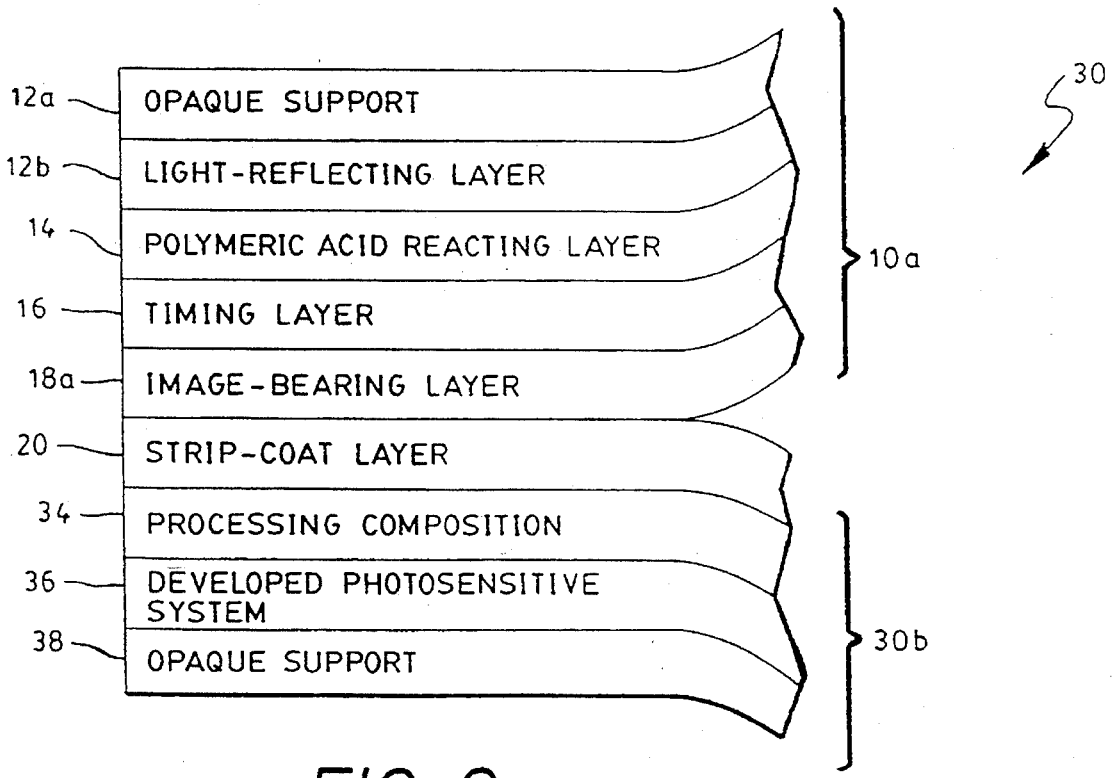
FIG. 2 is a partially schematic, cross-sectional view of a photographic film unit according to the invention, shown after exposure and processing.

In the embodiments illustrated in FIGS. 1 and 2, the image-receiving element 10, 10*a* includes a polymeric acid-reacting layer 14. The polymeric acid-reacting layer 14 reduces the environmental pH of the film unit, subsequent to transfer image formation. As disclosed, for example, in the previously referenced U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and layer 14 which comprises immobilized acid-reactive sites and which functions as a neutralization layer. Preferred polymers for neutralization layer 14 comprise such polymeric acids as cellulose acetate hydrogen phthalate; polyvinyl hydrogen phthalate; polyacrylic acid; polystyrene sulfonic acid; and maleic anhydride copolymers and half esters thereof.

Polymeric acid-reacting layer 14 can be applied, if desired, by coating support layer 12 with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of polymeric acid-reacting layer 14 comprises a mixture of a water soluble polymeric acid and a water soluble matrix, or binder, material. Suitable water-soluble polymeric acids include-ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in the following U.S. Pat. Nos.: 3,765,885; 3,819,371; 3,833,367, 3,754,910 and 5,427,899. A preferred polymeric acid-reacting layer 14 comprises a free acid of a copolymer of methyl vinyl ether and maleic anhydride and a vinyl acetate ethylene latex.

Timing layer 16 controls the initiation and the rate of capture of alkali by the acid-reacting polymer layer 14. The timing layer 16 may be designed to operate in a number of ways. For example, the timing layer 16 may act as a sieve, slowly metering the flow of alkali there through. Alternatively, the timing layer 16 may serve a "hold and release" function; that is, the timing layer 16 may serve as an alkali impermeable barrier for a predetermined time interval before converting in a rapid and quantitatively substantial fashion to a relatively alkali permeable condition, upon the occurrence of a predetermined chemical reaction. Examples of suitable timing layers are disclosed in U.S. Pat. Nos. 3,575,701; 4,201,587; 4,288,523; 4,297,431; 4,391,895; 4,426,481; 4,458,001; 4,461,824 and 4,547,451. As described in these patents, timing layers having the previously described characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layer 16 will typically be copolymers comprising repeating units of the previously described type (i.e., repeating units derived from polymerizable monomers capable of undergoing an alkali-initiated chemical reaction after a predetermined "hold time" interval) and comonomeric units incorporated into the polymer to impart thereto predetermined properties. For example, the hold time, i.e., the time interval during which timing layer 16 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 16 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymer to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 16, thereby altering the time necessary for initiation of the desired and predetermined chemical reaction. This latter means of adjusting the hold time of timing layer 16 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 16 and, thus, a longer hold time, may be obtained by increasing the hydrophobicity of the matrix polymer or increasing the degree of coalescence.

Examples of suitable comonomers which can be used in the production of copolymeric materials suited to application in timing layer 16 include acrylic acid; methacrylic acid; 2-acrylamido-2-methylpropane sulfonic acid; N-methyl acrylamide; methacrylamide; acrylamide, ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(2-hydroxyethyl)acrylamide, N-(b-dimethylaminoethyl)acrylamide; N-(t-butyl)acrylamide; N-[b(dimethylamino)ethyl]

methacrylamide; 2-[2'-(acrylamido)ethoxy]ethanol; N-(3'-methoxy propyl)acrylamide; 2-acrylamido-3-methylol butyramide; acrylamido acetamide; methacrylamido acetamide; 2-[2-methacrylamido-3'-methyl butyramido]acetamide; and diacetone acrylamide.

Matrix polymer systems adapted to utilization in timing layer 16 can be prepared by physical mixing of the matrix polymer and the polymer containing the repeating units capable of undergoing alkali-initiated chemical reaction, or by the preparation of the timing layer polymer in the presence of a pre-formed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in timing layer 16 of polymers or other materials which adversely affect or negate the desired alkali impermeable barrier properties of timing layer 16 is to be avoided. In this connection, it should be noted that gelatin, and particularly unhardened gelatin, is readily swollen and permeated by aqueous alkaline compositions typically employed in photographic processing. Accordingly, the presence in a timing layer of amounts of gelatin or other materials which promote rapid permeation of the layer by alkali and which effectively negate the hold character of the layer is to be avoided. Timing layer 16 is typically applied as a water-impermeable layer which results from the coalescence and drying of a coating composition, e.g., a latex composition.

The image-receiving layer 18 is designed for receiving an image-forming material which diffuses in an image-wise manner from the photosensitive element during processing. In color embodiments of the present invention, the image-receiving layer **18, 18*a*** generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061 to Howard C. Haas. Another image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346 issued to Stanley F. Bedell. Other materials can, however, be employed. Suitable mordant materials of the vinylbenzyltrialkylammonium type are described, for example, in U.S. Pat. No. 3,770,439, issued to Lloyd D. Taylor. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. One such hydrazinium mordant is poly(1-vinylbenzyl 1,1-dimethylhydrazinium chloride) which, for example, can be admixed with polyvinyl alcohol for provision of a suitable image-receiving layer.

In black and white embodiments of the invention, the image-forming material utilized is complexed silver which diffuses from the photosensitive element to the image-receiving layer during processing. The image-receiving layer utilized in such black and white embodiments typically includes silver nucleation materials, as is well known in the art.

In a preferred embodiment of the image-receiving elements of the invention, the image-receiving layer may include a crosslinkable material which is crosslinked by a borate compound which may be delivered during processing (typically under alkaline pH conditions, e.g. pH values higher than 9, and often higher than 12). A diffusion transfer photographic film unit wherein the processing composition includes a borate compound is described and claimed in copending, commonly assigned United States patent application, Ser. No. 08/568,964 filed on even date herewith. The terms "crosslink" or "crosslinkable" as used in connection with the use of borate compounds in this manner are intended to describe a chemical reaction taking place under processing conditions which results in the formation of a hydrogel. Suitable crosslinkable materials include polymers having functional groups which undergo crosslinking reactions under the conditions of photographic development with the previously described borate compounds. Examples of such crosslinkable materials include polymers having 1,2- or 1,3-hydroxyl groups, such as polyvinyl alcohol, and various copolymers of vinyl alcohol. Another class of materials is made up of boratable polysaccharides such as guar, alginate, Kelzan, and other members of the class which are often referred to as mannose gums. For a polysaccharide to be boratable, some of the sugar rings must have 1, 2- or 1,3-hydroxyl groups which are cis to one another, thus permitting spatially the formation of a strong cyclic borate complex. Guar gum contains boratable mannose cis glycol rings as well as a boratable galactose side chain. Alginate gums have rings which are made of boratable mannuronic acid as well as its boratable isomer, guluronic acid. These types of materials can also be derivatized as, for example, carboxymethyl guar, hydroxyethylguar and hydroxypropylalginate.

The crosslinkable material may act as mordant material, a binder material, or combination of both. For example, the mordant material may comprise a polyvinyl alcohol polymer with mordant polymer groups grained thereto. In preferred embodiments, the crosslinkable material is binder material for the layer. By way of specific example, a preferred image-receiving layer comprises a polyvinyl alcohol binder (crosslinkable) material, and a mordant material comprising a copolymer including the following monomer units:

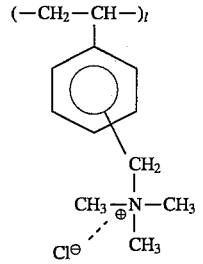

-continued

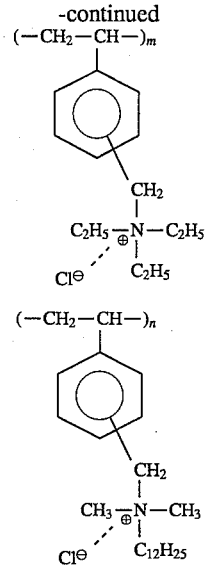

wherein 1, m, and n represent the relative molar ratios of each monomer unit and are preferably 0.45, 0.45 and 0.1 respectively.

The ideal ratio of mordant to binder will depend upon the specific materials used. In the example just provided, an ideal ratio is from 1:1 to 10:1, but preferably 2:1. Greater amounts of crosslinkable material typically reduce tack of the layer following processing, but also reduce image density. Thus, it is apparent that optimization is required depending upon the specific materials and photographic system used.

Strip-coat layer 20 facilitates the separation of image-receiving element 10*a* from the photosensitive element 30*b* as shown in FIG. 2. For example, in photographic film unit 30 which is processed by distribution of an aqueous alkaline processing composition 34 between the image-receiving element 10*a* and a photoexposed photosensitive element 30*b*, the strip-coat layer 20 serves to facilitate separation of the photograph 10*a* from the developed photosensitive system 36, processing composition layer 34 and support 38 (collectively 30*b*).

The strip-coat layer 20 of the present invention comprises a copolymer including: 1) at least about 50% by weight of a monomer unit derived from an ethylenically unsaturated carboxylic acid or salt thereof, 2) at least about 15% by weight of a monomer unit of vinyl pyrrolidone, and 3) at least about 5% by weight of a monomer unit, the same or different, represented by Formula I. As described previously, $R_1$ of each monomer unit is independently selected from: hydrogen, a substituted or unsubstituted alkyl having 1 to 4 carbon atoms, cyano, and halogen (e.g. chloride, bromide); X of each monomer is independently selected from —NH— or —O—; and $R_2$ of each monomer is independently selected from a hydroxy substituted alkyl group. Substituents for $R_1$ include a hydroxyl group, a halogen (e.g. chloride, bromide) atom, a cyano group, and an alkyl group. $R_1$ is preferably selected from hydrogen or methyl. $R_2$ is preferably a hydroxy substituted alkyl group having from 1 to 8 carbon atoms, and more preferably a hydroxy substituted alkyl group having from 1 to 4 carbon atoms. Particularly preferred monomer units include: hydroxyethyl methacrylate, hydroxypropyl methacrylate, hydroxyethyl acrylate, hydroxypropyl acrylate, N-acryloyl tris(hydroxymethyl)aminomethane, N-methacryloyl tris (hydroxymethyl) methylamine, and groups derived from monosaccharides, e.g. aldoses, alditols, (specific examples include 2-glucosylethyl methacrylate, gylcerol monoacrylate, glycerol monomethacrylate, etc.). Although the hydroxy substituted alkyl group represented by $R_2$ must include at least one hydroxyl group, other substituents may be present such as halogen, cyano, and additional alkyl groups.

As mentioned previously, copending commonly assigned United States patent application Ser. No. 08/568,964 describes a diffusion transfer photographic film unit wherein the processing composition includes a borate compound. It should be noted here that various of the monomer units within Formula I can crosslink when brought into contact with a borate compound under the alkaline photographic processing conditions. For example, di- or trihydroxy functionalized monomers where the hydroxyl units are spatially arranged in a position such as to form a 5 or 6 membered ring upon reaction with the borate compound can form hydrogels under the processing conditions. Of the monomer units described above, N-acryloyl tris (hydroxymethyl) aminomethane and N-methacryloyl tris(hydroxymethyl)aminomethane have such spatially arranged hydroxyl units.

The monomer unit derived from an ethylenically unsaturated carboxylic acid or salt thereof may include various monomer units, alone or in combination with one another. For example, the monomer unit derived from an ethylenically unsaturated carboxylic acid or salt may include one or more of the following: acrylic acid, methacrylic acid, maleic acid and derivatives thereof, e.g. methylvinylether maleic anhydride. Particularly preferred monomer units derived from an ethylenically unsaturated carboxylic acid or salt thereof may be represented by Formula II.

Formula II:

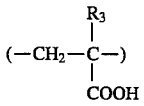

wherein $R_3$ of each monomer unit is independently selected from: hydrogen, a substituted or unsubstituted alkyl having 1 to 4 carbon atoms, cyano, and halogen (e.g. chloride, bromide). Preferably, $R_3$ is hydrogen or methyl. When $R_3$ is a substituted alkyl, applicable substituents include hydroxyl, halogen (e.g. chloride, bromide), cyano, and alkyl groups.

As described previously, the copolymer comprises at least about 50% by weight of the previously described ethylenically unsaturated carboxylic acid, at least about 15% by weight of the monomer units of vinyl pyrrolidone and at least about 5% by weight of the monomer units represented by the Formula I. A particularly preferred strip-coat layer includes a copolymer of acrylic acid, hydroxy propyl methacrylate, and vinyl pyrrolidone. Although such a composition does not crosslink in the presence of a borate compound under processing conditions, an independent crosslinkable material may be added to the strip-coat for crosslinking purposes. Suitable crosslinkable materials include polymers having functional groups which undergo crosslinking reactions under the conditions of photographic development with the previously described borate compounds. Examples of such crosslinkable materials include polymers having hydroxyl groups, preferably vicinal 1,2 or 1,3-hydroxyl groups such as polyvinyl alcohol, and various copolymers of vinyl alcohol. Additional examples of such crosslinkable materials include alginate, Kelzan, and polysaccharides including at least one mannitol unit such as mannose gums, e.g. guar, derivatized guar such as carboxymethyl guar, etc. By way of specific example, a preferred strip-coat includes a 60:40 (by dry weight) ratio of carboxymethyl guar to a copolymer comprising a 65:10:25 (by dry weight) ratio of the following monomers: acrylic acid, hydroxy propyl methacrylate, and vinyl pyrrolidone. Guar materials are available from the Rhone-Poulenc Company and the TIC Gums Company. A strip-coat coating solution containing carboxymethylguar may be prepared by slowly adding the carboxymethyl guar, in powder form, to water followed by about 30 minutes of stirring to create a mixture having 0.45% by weight solids, followed by addition of the copolymer and stirring for an additional 30 minutes. At this point other addenda such as a bacteriostat and a surfactant may be added. The mixture is then filtered with a 6 micron filter before coating.

It has been found that the strip-coat compositions of the invention can be coated at the dry coverage desired from coating solutions which have relatively lower solids contents, thus allowing more fluid to be deposited per unit area. In this manner the coating process is improved since problems which may arise when coating to deposit less fluid per unit area can be avoided.

In addition to the image-receiving layer 18 and strip-coat(s) 20, the polymeric acid layer 14 and timing layer 16 may also include the crosslinkable materials as described. By crosslinking the acid and/or timing layers during processing, the resulting image-receiving element is rendered stronger and less prone to subsequent water absorption.

Various borate compounds may be used in the processing composition to effect crosslinking of a crosslinkable material which is present in the image-receiving layer and/or other layer(s) of the image-receiving element. The particular borate compound utilized in any particular instance will be dependent upon the specific crosslinkable material(s) and the desired results. Nonetheless, borate compounds including at least one of the materials represented below are preferred:

(a) $H_3BO_3$; and (b) $xM_2O.\ yB_2O_3.\ zH_2O$;

wherein M represents a monovalent cation, x and y each represents a positive integer, and z represents zero or a positive integer. Particularly preferred borate compounds include boric acid ($H_3BO_3$), sodium borate ($Na_2\ B_2O_7\ 10H_2O$), and potassium borate ($K_2\ B_2O_7\ 10H_2O$). The described borate compounds may be used alone or in various combinations with one another and typically make up between 0.5% to 1.5% by weight of the processing composition. Although the precise amount of borate compound used may vary depending upon the specific photographic system used, in a preferred embodiment of the subject invention, approximately 1.0% by weight of the processing composition is sodium borate. In another preferred embodiment, approximately 0.85% by weight of the processing composition is boric acid.

When a strip-coat layer containing a crosslinkable material is used within the image-receiving element of the invention, it may be crosslinked before photographic processing, e.g. during coating of the layer. However, if the strip-coat is crosslinked prior to processing, image density is typically reduced. Thus, if such a layer is to be crosslinked, it is preferred to crosslink the layer during processing. For example, in one embodiment of the invention, the strip-coat includes a crosslinkable material which is substantially non-crosslinked prior to processing but which undergoes a crosslinking reaction when contacted with the borate compound within the processing composition.

Generally, the thickness of strip-coat layer 20 may vary and preferably is quite thin, i.e. from about 0.10 to about 1.251 μm (about 0.004 to about 0.05 mils). It is apparent that strip-coat layer 20 should not contain a mordant for the diffusing image dye-providing material and should not be so thick as to serve as an image-receiving layer itself or interfere with the transfer of the image dye-providing material to the underlying image-receiving layer 18. Generally, a strip-coat layer having a total coverage of from about 54 $mg/m^2$ (5 $mg/ft^2$) to about 1076 $mg/m^2$ (100 $mg/ft^2$) can provide the desired results.

The strip-coat layer described above may be incorporated in various types of image-receiving elements known in the art and the materials and the arrangement and order of the individual layers in such elements may vary. A particularly preferred image-receiving element according to the invention also includes a layer comprising silica particles together with one or more materials, the layer being arranged between the image-receiving layer 18 and the strip-coat layer 20. This layer reduces the time period for which the image-receiving element remains wet and sticky after the image-receiving element has been separated from the photosensitive element. An image-receiving element which includes such a layer is disclosed and claimed in U.S. Pat. 5,415,969 of Kenneth C. Waterman.

With reference to FIG. 2, a diffusion transfer peel-apart type photograph film unit according to the present invention is generally shown at 30. The film unit 30 includes a photoexposed photosensitive element **30*b* comprising a processing composition layer 34, a developable photosensitive system 36 and an opaque support 38. The film unit 30 is shown after photographic processing and prior to separation of an image-receiving element 10*a* from a processed photosensitive element 30*b*. Prior to processing, the processing composition 34** is typically contained within a pressure-rupturable pod, as is common in the art. Such pods and like structures are common in the art and generally define the means for providing the processing composition between the photosensitive element and image-receiving element. The processing composition typically comprises an aqueous alkaline solution including a developing agent and other addenda as is known in the art. Examples of such processing compositions are found in the following U.S. Pat. Nos. and the patents cited therein: Pat. Nos. 4,756,996; 3,455,685; 3,597,197; 4,680,247 and 5,422,233. As noted previously, the processing composition may include a borate compound capable of crosslinking a crosslinkable material within the image-receiving layer and/or other layer(s), e.g. strip-coat, of the image-receiving element.

It will be noted that strip-coat layer 20 is generally shown as being removed from image-bearing layer **18*a* upon separation of the image-receiving element 10*a* from photosensitive element 30*b* after photographic processing. Experiments have shown that where the strip-coat layer is formed with the terpolymer material of the invention, upon separation the strip-coat layer fractures with a part of the layer remaining attached to the image-bearing layer and the other part being removed with the photosensitive element. Experiments have also shown that where the strip-coat layer includes crosslinkable material such as guar and carboxymethyl guar in addition to the terpolymer material, more of the strip-coat layer remains adhered to image-bearing layer 18*a***.

The photosensitive system 36 comprises a photosensitive silver halide emulsion. In a preferred color embodiment of the invention, the photosensitive silver halide emulsion includes a corresponding diffusible dye, which upon processing is capable of diffusing to the image-receiving layer 18 as a function of exposure. In a preferred "black & white" embodiment of the invention, the image-forming material utilized is complexed silver which diffuses from the photosensitive element to the image-receiving layer during processing. Both such photosensitive systems are well known in the art and will be described in more detail hereinafter.

In further reference to FIG. 2, an image-receiving element 10*a* is generally shown, including layers 12*a*, 12*b*, 14, 16, 18 and 20. More specifically, an image-receiving element 10*a* is shown including a support 12*a*. The support may comprise an opaque support material 12*a*, such as paper, carrying a light-reflecting layer 12*b* thereon. On separation of the image-beating photograph 10*a*, the image in image-bearing layer 18*a* can be viewed against light-reflecting layer 12*b*. Light-reflecting layer 12*b* can comprise, for example, a polymeric matrix containing a suitable white pigment material, e.g., titanium dioxide.

The image-receiving elements of the present invention are particularly preferred for use in film units intended to provide multicolor dye images. The most commonly employed negative components for forming multicolor images are of the "tripack" structure and contain blue-, green-, and red-sensitive silver halide emulsion layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et at.). Photosensitive elements which include dye developers and a dye-providing thiazolidine compound can be used with good results and are described in U.S. Pat. No. 4,740,448 to P. O. Kliem.

It will be apparent that the image-receiving elements of the invention may be used in film units other than those specifically described. For example, the diffusion transfer photographic film unit described in Japanese patent application S61-252685, filed Oct. 23, 1986, is formed by placing a photosensitive element on a white supporting structure which is made up of at least: a) a layer having a neutralizing function; b) a pigment-receiving layer; and c) a peelable layer. The photosensitive element includes at least one silver halide emulsion layer associated with an image dye-providing material, an alkaline developing substance containing a light-shielding agent and a transparent cover sheet. Similarly, the subject invention may also be used in a peel apart film unit as described in U.S. Pat. No. 5,023,163.

The image-receiving element of the present invention is also applicable to black and white photographic film units. In such embodiments, a photosensitive element including a photosensitive silver halide emulsion is exposed to light and subject to an aqueous alkaline solution comprising a silver halide developing agent and a silver halide solvent. The developing agent reduces exposed silver halide to metallic silver and the solvent reacts with un-reduced silver halide to form a soluble silver salt complex. This soluble silver salt complex migrates to an image-receiving element. The image-receiving element typically comprises a support and an image-receiving layer including a silver precipitating material wherein the soluble silver salt complex is precipitated or reduced to form a visible silver "black and white" image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991; and 3,607,269 and in E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330.

As previously stated, the subject image-receiving element is also intended for use within photothermographic film units. Various embodiments of such film products are known and typically comprise: 1) a photosensitive element including at least one photosensitive silver halide emulsion, and with color embodiments, a corresponding image dye providing material, and 2) an image-receiving element including an image receiving material. Typically, the photosensitive element is exposed and subsequently brought in superposed contact with the image-receiving element, wherein the assembly is heated for a predetermined time period. In addition to heating, some applications require a small amount of water to be added to the photosensitive element prior to lamination with the image-receiving element. The application of heat, (and water if used), results in the image-wise diffusion of image materials (e.g. complexed silver in black and white embodiments, image dyes in color embodiments) from the photosensitive element, to the image-receiving element. Subsequently, the image-receiving element is separated from the photosensitive element. Various embodiments of photothermographic film units and processes are described in: S. H. Mervis and V. K. Walworth, *Kirk-Othmer Encyclopedia of Chemical Technology*, 4th. Edition, Volume 6, John Wiley & Sons, Inc. 1993, pp. 1036–1039. Specific examples of such film units are described in U.S. Pat. Nos.: 4,631,251; 4,650,748; 4,656,124; 4,704,345; 4,975,361; and 5,223,387. Typically, image-receiving elements used in photothermographic film units would not include the timing and/or acid-reacting layers as described with reference to the preferred photographic embodiment.

The invention will now be further described with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

A Control diffusion transfer photographic film unit was prepared wherein the image-receiving element comprised the following layer deposited in succession upon an opaque polyethylene clad paper support:

1. a polymeric acid-reacting layer at a coverage of about 22,219 mg/m$^2$ (2250 mg/ft$^2$), comprising 9 parts GANTREZ S-97 (a free acid of a copolymer of methyl vinyl ether and maleic anhydride available from the GAF Corp.), and 11 parts AIRFLEX 465 (a vinyl acetate ethylene latex available from the Air Products Co.);
2. a timing layer coated at a coverage of about 2691 mg/m$^2$ (250 mg/ft$^2$) comprising 1 part of Hycar 26349 (available from the B. F. Goodrich Co.) and parts of a graft polymer including the following materials in the approximate relative ratios indicated in parenthesis: a copolymer of diacetone acrylamide (8.2) and acrylamide (1.1) grafted onto polyvinyl alcohol (1);
3. an image-receiving layer coated at a coverage of about 3983 mg/m$^2$ (370 mg/ft$^2$) comprising: 2 parts of a copolymer comprising the following monomer units:

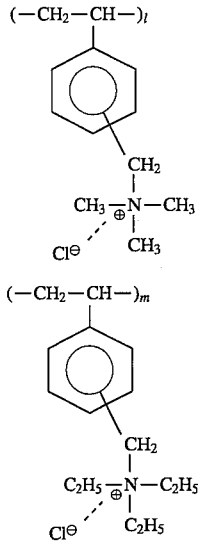

-continued

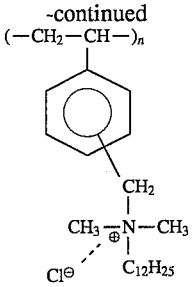

wherein 1, m, and n represent the relative molar ratios of each monomer unit and are preferably 0.45, 0.45 and 0.1, respectively; 1 part AIRVOL 165, (a super hydrolyzed polyvinyl alcohol material available from the Air Products Co.), and 1 part butanediol; and 4. a strip-coat layer of polyacrylic acid coated at a coverage of about 162 mg/m$^2$.

The photosensitive element comprised an opaque sub-coated polyethylene terephthalate photographic film base having the following layers coated thereon in succession:

1. a layer of sodium cellulose sulfate coated at a coverage of about 19 mg/m$^2$;
2. a cyan dye developer layer comprising about 960 mg/m$^2$ of the cyan dye developer represented by the formula

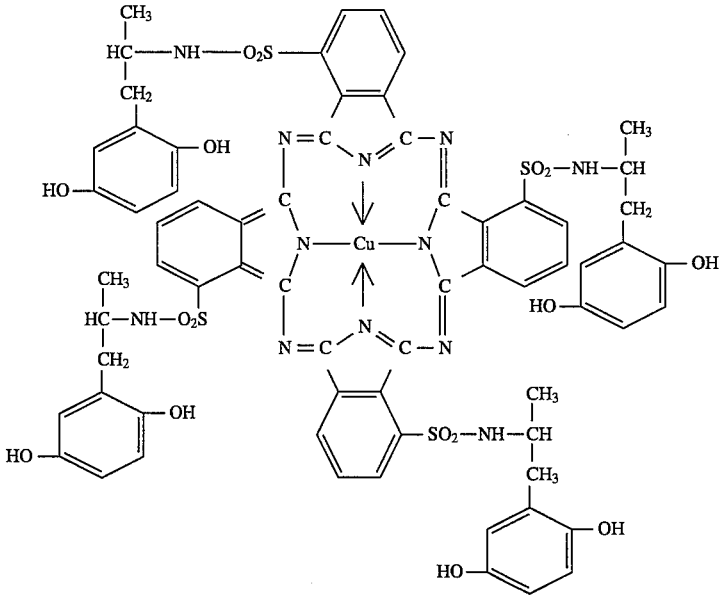

about 540 mg/m$^2$ of gelatin, about 12 mg/m$^2$ of sodium cellulose sulfate and about 245 mg/m$^2$ of phenyl norbornenyl hydroquinone (PNEHQ);

3. a red-sensitive silver iodobromide layer comprising about 780 mg/m$^2$ of silver (0.6 micron), about 420 mg/m$^2$ of silver (1.5 microns), about 720 mg/m$^2$ of gelatin and about 18 mg/m$^2$ of polyvinyl hydrogen phthalate;

4. an interlayer comprising about 2325 mg/mof a copolymer of butyl acrylate/diacetone acrylamide/methacrylic acid/styrene/acrylic acid, about 97 mg/m$^2$ of polyacrylamide, about 124 mg/m$^2$ of dantoin and about 3 mg/m$^2$ of succindialdehyde;

5. a magenta dye developer layer comprising about 455 mg/m$^2$ of a magenta dye developer represented by the formula

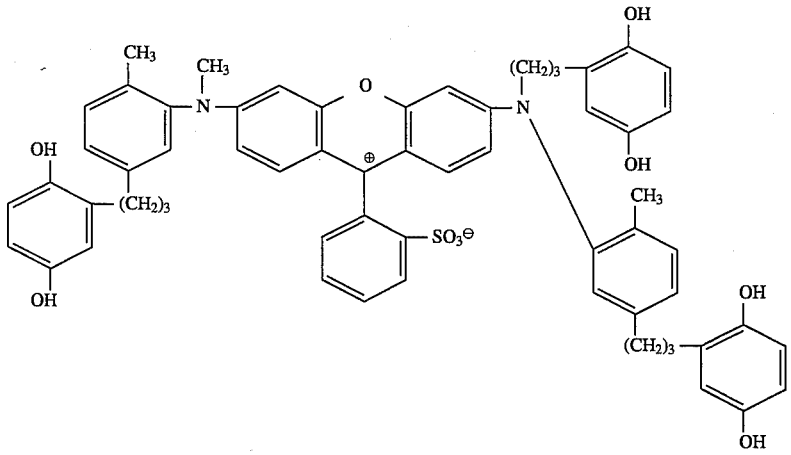

about 298 mg/m$^2$ of gelatin, about 234 mg/m$^2$ of 2-phenyl benzimidazole, about 14 mg/m$^2$ of phthalocyanine blue filter dye and about 12 mg/m$^2$ of sodium cellulose sulfate;

6. a spacer layer comprising about 250 mg/m$^2$ of carboxylated styrenebutadiene latex (Dow 620 latex), about 83 mg/m$^2$ of gelatin and about 2 mg/m$^2$ of polyvinyl hydrogen phthalate;

7. a green-sensitive silver iodobromide layer comprising about mg/m$^2$ of silver (0.6 micron), about 360 mg/m$^2$ of silver (1.3 microns), about 418 mg/m$^2$ of gelatin and about 23 mg/m$^2$ of polyvinyl hydrogen phthalate;

8. a layer comprising about 263 mg/m$^2$ of PNEHQ, about 131 mg/m$^2$ of gelatin and about 4 mg/m$^2$ of sodium cellulose sulfate;

9. an interlayer comprising about 1448 mg/m$^2$ of the copolymer described in layer 4 and about 76 mg/m$^2$ of polyacrylamide and about 4 mg/m$^2$ of succindialdehyde;

10. a layer comprising about 1000 mg/m$^2$ of a scavenger, 1-octadecyl-4,4-dimethyl-2-[2-hydroxy-5-(N-(7-caprolactamido)sulfonamido]thiazolidine, about 405 mg/m$^2$ of gelatin, about 12 mg/m$^2$ of sodium cellulose sulfate and about 7 mg/m$^2$ of quinacridone red zeta;

11. a yellow filter layer comprising about 241 mg/m$^2$ of benzidine yellow dye, about 68 mg/m$^2$ of gelatin and about 3 mg/m$^2$ of sodium cellulose sulfate;

12. a yellow image dye-providing layer comprising about 1257 mg/m$^2$ of a yellow image dye-providing material represented by the formula

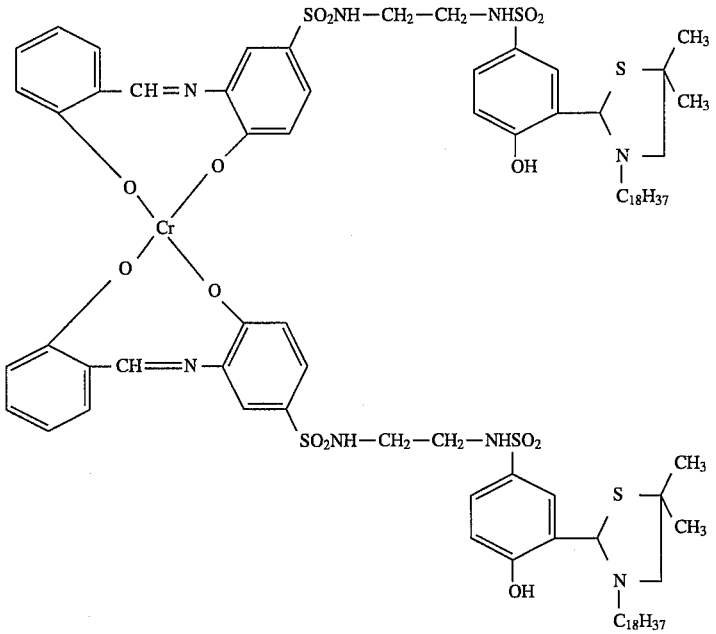

about 503 mg/m$^2$ of gelatin and about 20 mg/m$^2$ of sodium cellulose sulfate;

13. about 450 mg/m$^2$ of phenyl tertiarybutyl hydroquinone, about 100 mg/m$^2$ of 5-t-butyl-2,3-bis[(1-phenyl-1H-tetrazol-5-yl)thio]-1,4-benzenediol bis[(2-methanesulfonylethyl)carbamate]; about 250 mg/m$^2$ of gelatin and about 33 mg/m$^2$ of polyvinylhydrogen phthalate;
14. a blue-sensitive silver iodobromide layer comprising about 37 mg/m$^2$ of silver (1.3 microns), about 208 mg/m$^2$ of silver (1.6 microns), about 78 mg/m$^2$ of gelatin and about 7 mg/m$^2$ of polyvinyl-hydrogen phthalate;
15. a layer comprising about 500 mg/mof an ultraviolet filter, Tinuvin (Ciba-Geigy), about 220 mg/m$^2$ of benzidine yellow dye, about 310 mg/m$^2$ of gelatin and about 23 mg/mof sodium cellulose sulfate; and
16. a layer comprising about 300 mg/m$^2$ of gelatin and about 9 mg/mof polyvinylhydrogen phthalate.

The Control film unit was processed with an aqueous alkaline processing composition described in Table I.

TABLE I

| Component | Parts by Weight |
|---|---|
| Potassium hydroxide | 7.25 |
| Hydroxy PMT (parahydroxyphenyl mercapto tetrazole) | 0.004 |
| N-butyl-a-picolinium bromide | 1.79 |
| 1-methylimidazole | 0.24 |
| 1,2,4-triazole | 0.30 |
| hypoxanthine | 0.82 |
| PMT (phenyl mercapto tetrazole) | 0.0005 |
| 6-benzylamino purine | 0.025 |
| 2-(methylamino)ethanol | 0.17 |
| Guanine | 0.12 |
| Boric acid | 0.71 |
| 5-amino-1-pentanol | 1.64 |
| Hydrophobically modified hydroxyethylcellulose (Natrosol Plus ™ available from Aqualon) | 2.49 |
| Sodium salt of paratoluene sulfinic acid | 0.41 |
| Titanium dioxide | 0.16 |

TABLE I-continued

| Component | Parts by Weight |
|---|---|
| 6-methyl uracil | 0.45 |
| Water | Balance to 100 |

The Control film unit was processed by initially exposing the photosensitive element to a standard photographic sensitometric target, bringing the exposed photosensitive element into superposed relationship with the image-receiving element and passing the combination through a pair of pressure rollers so as to rupture a rupturable container containing the aqueous alkaline processing composition and affixed between the respective elements so as to distribute the processing composition between the respective elements.

A number of identical Control film units were prepared and processed in the manner described with each being subjected to different processing conditions. Each of the film units was evaluated for various properties, i.e., image density, haze, hot haze and processing composition stick (the amount of processing composition remaining on the image-receiving layer after processing and separation of the image-receiving element from the photosensitive element)

A Control film unit was tested for image density by processing the film unit at room temperature between a pair of pressure rollers having a gap width of about 0.0036" followed by an imbibition period of about 90 seconds, at which time the photosensitive element was separated from the image-receiving element. Image density for red, green and blue wavelengths were tested for each film unit and the results are provided in Table II below.

Other Control film units were tested, at room temperature and 90 seconds imbibition and at 95° F. and imbibition times of 60 seconds and 90 seconds, respectively, and the images were visually observed to detect the presence of haze (typically caused by light scattering).

Another Control film unit, after processing at 95° F. and 90 seconds imbibition using a roller gap width of 0.0054", was visually examined to estimate the area of the image-receiving layer to which processing composition remained affixed.

EXAMPLE II

Film units A–C according to the invention were prepared which were identical to the Control with the exception that the strip-coat layer of the Control was replaced by a strip-coat layer, coated at a coverage of about 162 mg/m$^2$, according to the invention as follows:

| FILM UNIT | STREP-COAT COMPOSITION | RATIO (WT. %) |
|---|---|---|
| A | AA/VP/HPMA | 75/15/10 |
| B | AA/VP/TRISOH | 65/25/10 |
| C | AA/VP/HPMA | 65/25/10 |

AA is acrylic acid monomer

VP is n-vinylpyrrolidone

HPMA is hydroxypropylmethacrylate monomer

TRISOH is N-methacryloyl tris(hydroxymethyl)methylamine

The copolymers for the strip-coats of each of film units A–C were synthesized by a semi-continuous solution polymerization utilizing a monomer mixture feed rate of about 2 ml/minute at a temperature of approximately 80° C., under a constant agitation rate of approximately 180 r.p.m. The specific synthesis used for the copolymer used in film unit C is provided below, it being understood that the copolymers used in film units A and B were synthesized by a substantially similar method, but for the amount and type of monomers used.

The copolymer used in film unit C was prepared by heating approximately 2,136 grams of water to about 80° C. The water was deaerated with nitrogen and maintained under a nitrogen "blanket". Subsequently, about 4.8 grams of ammonium persulfate initiator was added (in a solution of about 20 grams of water) to the heated water. About 312 grams of acrylic acid, 48 grams of hydroxypropyl methacrylate monomer (available from Aldrich as 26,854-2, a 97% mixture of isomers), and 120 grams of vinylpyrrolidone monomer (n-vinyl-2-pyrrolidone as a 99.5% redistilled optical grade solution available from Polysciences Inc.) were added together and subsequently added to the heated water at an approximate rate of 2 ml/minute. (Although not done in the present Examples, upon completion of monomer feed, the mixture may be maintained at 80° C. for 30–60 minutes in order to assist in reducing remaining monomer). Subsequently, a post catalyst redox pair was added comprising about 0.33 grams of t-butyl-hydroperoxide and about 0.61 grams of isoascorbic acid in about 10.0 grams of water. The reaction mixture was held for approximately one hour at 80° C. for post catalysis. (Although not performed in the present Examples, it is preferred that the mixture be maintained at about 80° C. for about 30 minutes and then cooled to about 50° C. prior to adding the above-noted post catalyst redox pair. After adding the redox pair, the mixture is preferably maintained at 50° C. for approximately 1 hour.)

Oven analysis consisting of heating the copolymer to 110° C. for two hours indicated a solid content of approximately 17.9% by weight. Brookfield viscosity was measured to approximately 18.2 cPs and the pH of the mixture was approximately 2.0. The weight average molecular weight was approximately 57,000 determined by GPC/viscosity measurements utilizing: a Waters model 150C Gel Permeation Chromatograph (GPC) with a PL gel 10 μ1000 Å, PL gel 10 μ500 Å, and PL gel 10 μ50 Å linear columns, and a refractive index detector (Waters model 401) and a intrinsic viscosity detector (VISCOTEK model 150R). The solvent used was dimethylsulfoxide and 0.1M LiBr. The solvent flow rate was approximately 0.8 ml/minute.

Aging studies have shown that the polymeric solutions can be stored at temperatures of from about 4° C. to about room temperature for up to ten weeks without affecting performance of the materials. Some discoloration of the solution was observed upon storage at a temperature of about 40° C.

Film units A–C were tested as described above with respect to the Control film units. The results obtained are shown in Table II.

TABLE II

| FILM UNIT | IMAGE DENSITY R.T. | IMAGE DENSITY 95° F.; 60 SEC. | IMAGE DENSITY 95° F.; 90 SEC. | % SURFACE WITH PROCESSING COMPOSITION REMAINING |
|---|---|---|---|---|
| Control | R 2.14 | R 2.00 | R 2.33 | 55 |
| | G 2.40 | G 2.22 | G 2.32 | |
| | B 1.89 | B 2.04 | B 2.13 | |
| A | R 2.26 | R 1.96 | R 2.29 | 0 |
| | G 2.34 | G 2.14 | G 2.25 | |
| | B 1.87 | B 1.91 | B 2.05 | |
| B | R 2.21 | R 2.01 | R 2.22 | 0 |
| | G 2.37 | G 2.18 | G 2.22 | |
| | B 1.89 | B 1.96 | B 2.06 | |
| C | R 2.17 | R 2.10 | R 2.37 | 0 |
| | G 2.36 | G 2.21 | G 2.36 | |
| | B 1.85 | B 2.00 | B 2.14 | |

The image-receiving layer of the Control film unit, after processing and separation, exhibited processing composition adhered to about 55% of the surface area of the image-receiving layer. In film units A–C of the invention, the processing composition separated completely from the image-receiving layers after processing and separation. The Control film unit and film units A–C all exhibited some haze.

EXAMPLE III

Film units D–F according to the invention were prepared which were identical to film unit C with the exception that the strip-coat layer for film unit D was coated at a coverage of about 75 mg/m$^2$ and the strip-coat layer for film unit E was coated at a coverage of about 108 mg/m$^2$. The strip-coat layer for film unit F was coated at a coverage of about 161 mg/m$^2$, the same as that of film unit C.

Film units D–F were processed as described in Example I at room temperature with a 0.0034" roller gap and a 90 second imbibition time period. The results obtained are shown in Table III.

TABLE III

| FILM UNIT | IMAGE DENSITY R | G | B |
|---|---|---|---|
| D | 2.24 | 2.10 | 1.68 |
| E | 2.27 | 2.13 | 1.71 |
| F | 2.27 | 2.15 | 1.71 |

Other film units D–F were processed at 95° F. with a 0.0054" roller gap and a five minute imbibition time period. At this extended imbibition period the image-bearing receiving layers of each film unit exhibited some processing composition adhered thereto, approximately 50% for D, 60% for E and 15% for F. Thus, the strip-coat layer coated at a coverage of about 161 mg/m$^2$ provided the best results in this test.

Other film units D–F were processed at 95° F. with a roller gap of 0.0034" and a 90 second imbibition time period. After the developed image dried, the images were visually observed to detect the presence of any localized haze spots. Each image exhibited some localized haze.

EXAMPLE IV

Film units G and H according to the invention were prepared which were identical to film units E and F respectively, with the exception that the strip-coat layers of film units G and H comprised a 1:1 ratio (by weight) of copolymer (film unit C) and guar. Film units G and H were processed as described in Example III.

TABLE IV

| FILM UNIT | IMAGE DENSITY R | G | B |
|---|---|---|---|
| G | 2.27 | 2.19 | 1.79 |
| H | 2.28 | 2.28 | 1.82 |

At elevated temperature processing (95° F.) and extended imbibition time period of five minutes, film units G and H exhibited less processing composition stick, i.e., about 20% for film unit G and about 30% for film unit H.

Neither film unit exhibited any localized haze spots upon drying of the image-bearing surface of the image-receiving element.

It can be seen that film unit H provided the best overall performance considering image density, absence of any localized haze upon drying and sticking of the processing composition to the image-bearing surface.

EXAMPLE V

Film units I and J according to the invention were prepared which were identical to film units G and H respectively with the exception that the strip-coat layers of film units I and J comprised a 60:40 ratio (by weight) of carboxymethyl guar and copolymer. The strip-coat layer for film unit I was coated at a coverage of 97 mg/m$^2$ and that for film unit J at a coverage of 161 mg/m$^2$.

Film units I and J were processed as described in Example III.

TABLE V

| FILM UNIT | IMAGE DENSITY R | G | B |
|---|---|---|---|
| I | 2.59 | 2.45 | 1.78 |
| J | 2.43 | 2.42 | 1.80 |

At elevated temperature processing (95° F.) and extended imbibition time period of five minutes, film unit I exhibited about 30% processing composition stick and film unit J about 20%. Neither film unit exhibited any localized haze spots upon drying of the image-bearing surface of the image-receiving element.

It can be seen that film units I and J provided the highest red, green and blue densities.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

We claim:

1. An image-receiving element for use in a photographic or photothermographic diffusion transfer process comprising in sequence:

a support;

an image-receiving layer; and a strip-coat layer overlying said image-receiving layer, said strip-coat layer comprising a copolymer including: 1) at least about 50% by weight of monomer units, the same or different, derived from an ethylenically unsaturated carboxylic acid or salt thereof, 2) at least about 15% by weight of monomer units of vinyl pyrrolidone, and 3) at least about 5% by weight of monomer units, the same or different, represented by the formula:

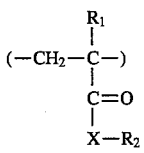

wherein $R_1$ of each monomer unit is independently selected from: hydrogen, a substituted or unsubstituted alkyl having 1 to 4 carbon atoms, cyano, and halogen; X of each monomer unit is independently selected from —NH— or —O—; and $R_2$ of each monomer unit is independently selected from a hydroxy substituted alkyl group.

2. An image-receiving element as set forth in claim 1 wherein said monomer units derived from an ethylenically unsaturated carboxylic acid or salt thereof are represented by the formula:

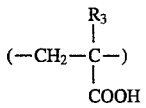

wherein $R_3$ of each monomer unit is independently selected from: hydrogen, a substituted or unsubstituted alkyl having 1 to 4 carbon atoms, cyano, and halogen.

3. An image-receiving element as set forth in claim 2 wherein $R_3$ is hydrogen or methyl.

4. An image-receiving element as set forth in claim 1 wherein $R_2$ is a hydroxy substituted alkyl group having from 1 to 8 carbon atoms.

5. An image-receiving element as set forth in claim 1 wherein $R_1$ is hydrogen or methyl; X is —O—, and $R_2$ is a hydroxy-substituted alkyl group having from 1 to 4 carbon atoms.

6. An image-receiving element as set forth in claim 3 wherein said copolymer comprises monomer units of acrylic acid, vinyl pyrrolidone, and hydroxypropylmethacrylate.

7. An image-receiving element as set forth in claim 1 wherein said strip-coat further includes at least one mannose gum material.

8. An image-receiving element as set forth in claim 7 wherein said mannose gum material includes carboxymethyl guar.

9. An image-receiving element as set forth in claim 8 wherein said copolymer comprises monomer units of acrylic acid, vinyl pyrrolidone, and hydroxypropylmethacrylate.

10. A diffusion transfer film unit adapted for use in photographic and photothermographic processes, said film unit comprising:

a photosensitive element comprising a support carrying at least one silver halide emulsion;

an image-receiving element adapted to be separated from said photosensitive element following photoexposure and processing, said image-receiving element comprising in sequence: a support, an image-receiving layer, and a strip-coat layer overlying said image-receiving layer, said strip-coat layer comprising a copolymer including: 1) at least about 50% by weight of monomer units, the same or different, derived from an ethylenically unsaturated carboxylic acid or salt thereof, 2) at least about 15% by weight of monomer units of vinyl pyrrolidone, and 3) at least about 5% by weight of monomer units, the same or different, represented by the formula:

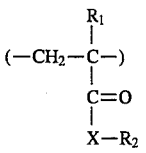

wherein $R_1$ of each monomer unit is independently selected from: hydrogen, a substituted or unsubstituted alkyl having 1 to 4 carbon atoms, cyano, and halogen; X of each monomer unit is independently selected from —NH— or —O—; and $R_2$ of each monomer unit is independently selected from a hydroxy substituted alkyl group.

11. A film unit as set forth in claim 10 wherein said monomer units derived from an ethylenically unsaturated carboxylic acid or salt thereof are represented by the formula:

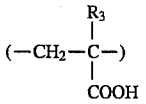

wherein $R_3$ of each monomer unit is independently selected from: hydrogen, a substituted or unsubstituted alkyl having 1–4 carbon atoms, cyano, and halogen.

12. A film unit as set forth in claim 11 wherein $R_3$ is hydrogen or methyl.

13. A film unit as set forth in claim 10 wherein $R_2$ is a hydroxy-substituted alkyl group having from 1 to 8 carbon atoms.

14. A film unit as set forth in claim 13 wherein $R_1$ is hydrogen or methyl; X is —O—, and $R_2$ is a hydroxy-substituted alkyl group having from 1 to 4 carbon atoms.

15. A film unit as set forth in claim 14 wherein said copolymer comprises monomer units of acrylic acid, vinyl pyrrolidone, and hydroxypropyl methacrylate.

16. A film unit as set forth in claim 10 wherein said strip-coat layer includes at least one mannose gum material.

17. A film unit as set forth in claim 16 wherein said mannose gum material includes carboxymethyl guar.

18. A film unit as set forth in claim 17 wherein said copolymer comprises monomer units of acrylic acid, vinyl pyrrolidone, and hydroxy propyl methacrylate.

* * * * *